US011488557B2

(12) United States Patent
Zhang et al.

(10) Patent No.: US 11,488,557 B2
(45) Date of Patent: Nov. 1, 2022

(54) GATE DRIVER ON ARRAY CIRCUIT LAYOUT

(71) Applicant: Shenzhen China Star Optoelectronics Semiconductor Display Technology Co., Ltd., Shenzhen (CN)

(72) Inventors: Liuqi Zhang, Shenzhen (CN); Baixiang Han, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 342 days.

(21) Appl. No.: 16/627,785

(22) PCT Filed: Oct. 30, 2019

(86) PCT No.: PCT/CN2019/114173

§ 371 (c)(1),
(2) Date: Dec. 31, 2019

(87) PCT Pub. No.: WO2021/046987

PCT Pub. Date: Mar. 18, 2021

(65) Prior Publication Data

US 2021/0358441 A1 Nov. 18, 2021

(30) Foreign Application Priority Data

Sep. 12, 2019 (CN) ..... 201910862779.0

(51) Int. Cl.
*G09G 3/20* (2006.01)
*G09G 3/36* (2006.01)

(52) U.S. Cl.
CPC ... *G09G 3/3677* (2013.01); *G09G 2300/0852* (2013.01); *G09G 2330/045* (2013.01)

(58) Field of Classification Search
CPC ..... G09G 3/3677; G09G 2300/0852; G09G 2330/045; G09G 2300/0408;
(Continued)

(56) References Cited

U.S. PATENT DOCUMENTS

2002/0196243 A1* 12/2002 Morita ..... G09G 3/3611 345/204
2004/0141098 A1 7/2004 Suzuki et al.
(Continued)

FOREIGN PATENT DOCUMENTS

CN 1517750 8/2004
CN 102856309 1/2013
(Continued)

*Primary Examiner* — Lunyi Lao
*Assistant Examiner* — Jarurat Suteerawongsa

(57) ABSTRACT

A gate driver on array (GOA) circuit layout is provided, including a plurality of driving thin-film transistor units, wherein each of the driving thin-film transistor units includes a wiring side and a capacitor side, and any two adjacent driving thin-film transistor units are spaced apart and connected in series with each other; and a plurality of first capacitor areas, wherein each of the first capacitor areas is disposed between two adjacent capacitor sides of the driving thin-film transistor units. The GOA circuit layout according to the present invention increases heat dissipation area for the driving thin-film transistors, which is more advantageous for heat dissipation. On the other hand, because of sufficient use of the first capacitor areas, a size of layout is basically not increased.

13 Claims, 3 Drawing Sheets

(58) Field of Classification Search
CPC ... G09G 2300/0426; G09G 2310/0267; G09G 3/20; G09G 3/3648; G09G 3/3208
See application file for complete search history.

(56) References Cited

U.S. PATENT DOCUMENTS

| | | | | |
|---|---|---|---|---|
| 2005/0156845 | A1 | 7/2005 | Lee | |
| 2007/0018630 | A1* | 1/2007 | Oehm | H03F 3/45183 323/313 |
| 2013/0001792 | A1 | 1/2013 | Uno et al. | |
| 2015/0070616 | A1* | 3/2015 | Ogasawara | G02F 1/1339 349/43 |
| 2015/0356934 | A1* | 12/2015 | Yamashita | G09G 3/3611 345/99 |
| 2016/0043055 | A1* | 2/2016 | Song | H01L 27/1214 257/774 |
| 2016/0118409 | A1* | 4/2016 | Jin | H01L 27/1248 257/59 |
| 2017/0249916 | A1* | 8/2017 | Jen | G09G 3/3677 |

FOREIGN PATENT DOCUMENTS

| | | |
|---|---|---|
| CN | 104483771 | 4/2015 |
| CN | 105679261 | 6/2016 |
| CN | 205911298 | 1/2017 |
| CN | 107134264 | 9/2017 |
| CN | 107329341 | 11/2017 |
| CN | 206893620 | 1/2018 |
| WO | WO 2013/157285 | 10/2013 |

* cited by examiner

GATE DRIVER ON ARRAY CIRCUIT LAYOUT

RELATED APPLICATIONS

This application is a National Phase of PCT Patent Application No. PCT/CN2019/114173 having International filing date of Oct. 30, 2019, which claims the benefit of priority of Chinese Patent Application No. 201910862779.0 filed on Sep. 12, 2019. The contents of the above applications are all incorporated by reference as if fully set forth herein in their entirety.

FIELD AND BACKGROUND OF THE INVENTION

The present invention relates to the technical field of display, and especially to a gate driver on array (GOA) circuit layout.

With continuing development of display technology, people's demand for high contrast, high resolution, narrow border, and thin panels has become stronger. In order to achieve this goal, current mainstream products of display technologies such as liquid crystal displays, organic light-emitting diode displays, etc. widely adopt gate driver on array (GOA) driving circuits as gate driving circuits. However, because GOA circuits adopt alternating current driving, some thin-film transistors would fail due to severe self-heating effect, especially driving thin-film transistors with larger sizes.

FIG. 1 is a schematic diagram of layout relation between driving thin-film transistors and a capacitor in a conventional GOA circuit layout. The conventional GOA circuit layout independently disposes a capacitor area 2 below a driving thin-film transistor area 1 or at the right side (not shown), and has a problem of insufficient heat dissipation.

SUMMARY OF THE INVENTION

The present invention provides a GOA circuit layout to resolve the technical problem of insufficient heat dissipation of the conventional GOA circuit layout.

In order to resolve the above-mentioned problem, the present invention provides the following technical approach.

The present invention provides a gate driver on array (GOA) circuit layout that includes a plurality of driving thin-film transistor units, wherein each of the driving thin-film transistor units comprises a wiring side and a capacitor side, and any two of the adjacent driving thin-film transistor units are disposed spacing with and are in series with each other; and a plurality of first capacitor areas, wherein each of the first capacitor areas is disposed between two of the adjacent capacitor sides of the driving thin-film transistor units.

According to at least one embodiment of the present invention, the driving thin-film transistor units are shaped as rectangles, the wiring side is located on a short side of the rectangles, and the capacitor side is located on a lone side of the rectangles.

According to at least one embodiment of the present invention, the GOA circuit layout further includes series wiring disposed on the wiring side of the driving thin-film transistor units, and any two of the adjacent driving thin-film transistor units are in series with each other through the series wiring.

According to at least one embodiment of the present invention, each of the driving thin-film transistor units includes two channels, a length direction of the channels is in parallel with the capacitor side, and distance between two of the adjacent first capacitor areas is greater than or equal to width of the two channels.

According to at least one embodiment of the present invention, widths of the channels are adjustable.

According to at least one embodiment of the present invention, each of the driving thin-film transistor units further includes a source side and a drain side located on the wiring side.

According to at least one embodiment of the present invention, the GOA circuit layout further includes a plurality of second capacitor areas, wherein each of the second capacitor areas is disposed on the source side and is connected to the first capacitor areas through the source side.

According to at least one embodiment of the present invention, the driving thin-film transistor units in series with each other include the driving thin-film transistor units located at two ends of a series structure and the driving thin-film transistor units located at middle of the series structure, the driving thin-film transistor units located at the two ends of the series structure include one channel, and a length direction of the channel is in parallel with the capacitor side.

According to at least one embodiment of the present invention, the GOA circuit layout further includes a plurality of second capacitor areas, wherein each of the second capacitor areas is disposed on the drain side and is connected to the first capacitor areas through the drain side.

The GOA circuit layout according to the present invention increases heat dissipation area for the driving thin-film transistors, which is more advantageous for heat dissipation. On the other hand, because of sufficient use of the first capacitor areas, size of layout is basically not increased.

BRIEF DESCRIPTION OF THE SEVERAL VIEWS OF THE DRAWINGS

In order to further understand features and technical contents of the present invention, please refer to the following detailed description and accompanying drawings of the present invention. However, the accompanying drawings are used for purpose of explanation and do not limit the present invention.

With reference to the following drawings, the technical approach and other beneficial effects of the present invention will be obvious through describing embodiments of the present invention in detail.

The drawings are as the following.

FIG. 1 is a schematic diagram of layout relation between driving thin-film transistors and a capacitor in a conventional gate driver on array (GOA) circuit layout.

FIG. 2 is a schematic diagram of layout relation between driving thin-film transistors and a capacitor in a GOA circuit layout according to the present invention.

FIG. 3 is a schematic diagram of a GOA circuit layout according to a first embodiment of the present invention.

FIG. 4 is a schematic diagram of a GOA circuit layout according to a second embodiment of the present invention.

DESCRIPTION OF SPECIFIC EMBODIMENTS OF THE INVENTION

In order to further describe the technical approach and the effects of the present invention, the following describes in detail with reference to advantageous embodiments and the accompanying drawings of the present invention.

The present invention directs to the technical problem of insufficient heat dissipation of the conventional gate driver on array (GOA) circuit layout, and the present embodiment can resolve this drawback.

Figure 1:
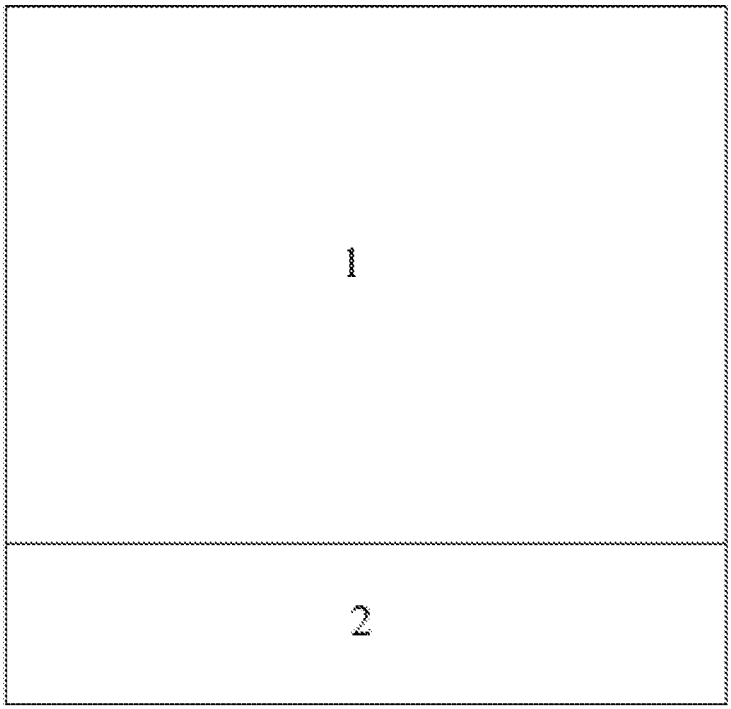
Figure 2:
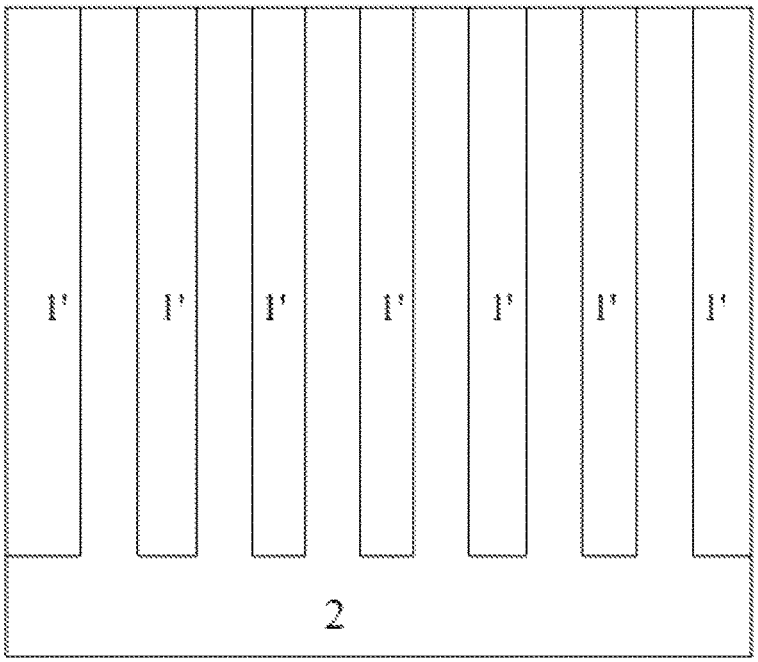

FIG. 2 is a schematic diagram of layout relation between driving thin-film transistors and a capacitor in a GOA circuit layout according to the present invention. The present invention divides a driving thin-film transistor area 1 into a series structure of a plurality of driving thin-film transistor units 1', and inserts a capacitor area 2 between each of the smaller driving thin-film transistor units 1'; thereby reasonably using the capacitor area 2 to divide the driving thin-film transistor area 1 to increase heat dissipation area for the driving thin-film transistor area 1 and realize heat dissipation function.

Figure 3:
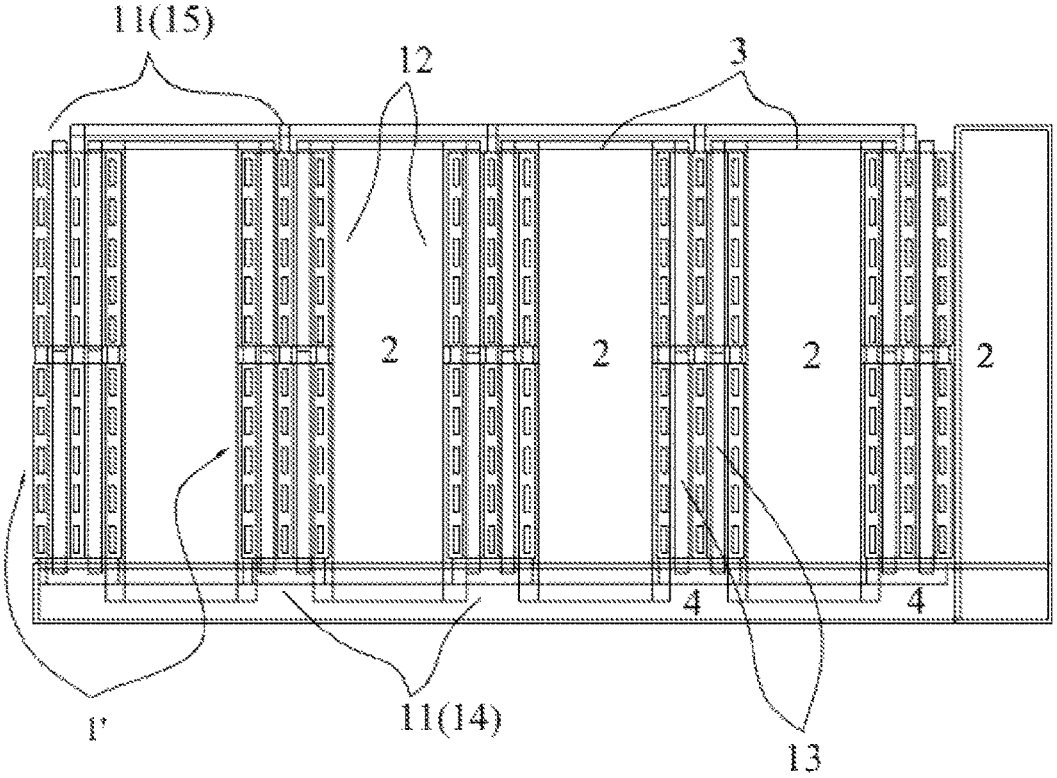

FIG. 3 is a schematic diagram of a GOA circuit layout according to a first embodiment of the present invention. The GOA circuit layout includes a plurality of driving thin-film transistor units 1', wherein each of the driving thin-film transistor units 1' includes a wiring side 11 and a capacitor side 12, and any two of the adjacent driving thin-film transistor units 1' are spaced apart and connected in series with each other; and a plurality of capacitor areas 2, wherein each of the capacitor areas 2 is disposed between two of the adjacent capacitor sides 12 of the driving thin-film transistor units 1'.

The driving thin-film transistor units 1' are shaped as rectangles, the wiring side 11 is located on a short side of the rectangles, and the capacitor side 12 is located on a long side of the rectangles. The GOA circuit layout further includes series wiring 3 disposed on the wiring side 11 of the driving thin-film transistor units 1', and any two of the adjacent driving thin-film transistor units 1' are connected in series with each other through the series wiring 3.

As shown in FIG. 3, first capacitor areas 2 are inserted between the driving thin-film transistor units 1', which is divided into five parts, and each of the driving thin-film transistor units 1' is connected in series with each other through the series wiring 3 on the wiring side 11. On the one hand, heat dissipation area for the driving thin-film transistor units 1' is increased, which is more advantageous for heat dissipation. On the other hand, because of sufficient use of the first capacitor areas 2, size of layout is basically not increased.

In the present embodiment, each of the driving thin-film transistor units 1' includes two channels 13, a length direction of the channels 13 is parallel with the capacitor side 12, and a distance between two of the adjacent first capacitor areas 2 is greater than or equal to a width of the two channels 13. Widths of the channels 13 are adjustable. Each of the driving thin-film transistor units 1' further includes a source side 14 and a drain side 15 located on the wiring side 11. The GOA circuit layout further includes a plurality of second capacitor areas 4, wherein each of the second capacitor areas 4 is disposed on the source side 14 and is connected to the first capacitor areas 2 through the source side 14.

Figure 4:
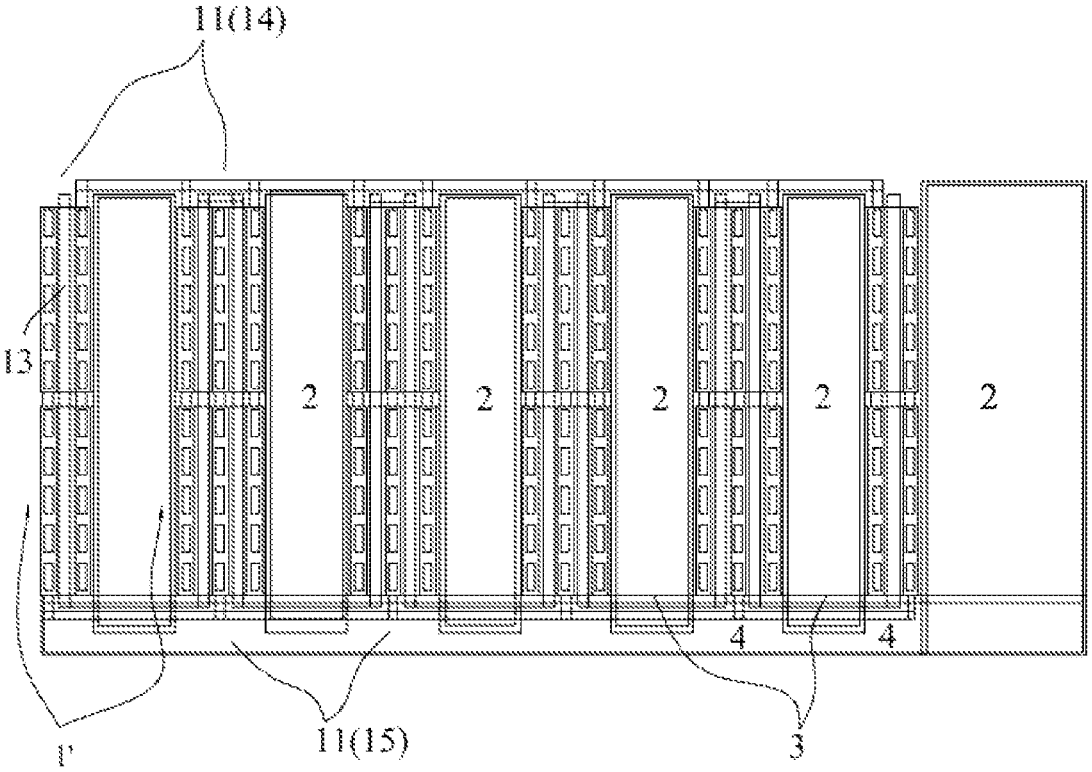

FIG. 4 is a schematic diagram of a GOA circuit layout according to a second embodiment of the present invention. As shown, first capacitor areas 2 are inserted between the driving thin-film transistor units 1', which are divided into six parts, and each of the driving thin-film transistor units 1' is connected in series with each other through the series wiring 3 on the wiring side 11. On the one hand, heat dissipation area for the driving thin-film transistor units 1' is increased, which is more advantageous for heat dissipation. On the other hand, because of sufficient use of the first capacitor areas 2, size of layout is basically not increased.

In the present embodiment, different from the first embodiment, the driving thin-film transistor units 1' connected in series with each other include the driving thin-film transistor units 1' located at two ends of a series structure and the driving thin-film transistor units 1' located at a middle of the series structure, the driving thin-film transistor units 1' located at the two ends of the series structure include one channel 13, and a length direction of the channel is parallel with the capacitor side. Each of the driving thin-film transistor units 1' further includes a source side 14 and a drain side 15 located on the wiring side 11. The GOA circuit layout further includes a plurality of second capacitor areas 4, wherein each of the second capacitor areas 4 is disposed on the drain side 15 and is connected to the first capacitor areas 2 through the drain side 15.

Because drain voltage of a thin-film transistor is higher during a course of operation, voltage difference between gate and drain is less than that between gate and source; hence, resistance between gate and drain is greater and heat is more easily produced. Therefore, the present invention provides the above two embodiments.

Beneficial effects: the GOA circuit layout according to the present invention increases heat dissipation area for the driving thin-film transistors, which is more advantageous for heat dissipation. On the other hand, because of sufficient use of the first capacitor areas 2, size of layout is basically not increased.

Although the present invention has been explained in relation to its preferred embodiment, it does not intend to limit the present invention. It is obvious to those skilled in the art having regard to this present invention that other modifications of the exemplary embodiments beyond these embodiments specifically described here may be made without departing from the spirit of the invention. Accordingly, such modifications are considered within the scope of the invention as limited solely by the appended claims.

What is claimed is:

1. A gate driver on array (GOA) circuit layout, comprising:

a driving thin-film transistor area divided into a plurality of driving thin-film transistor units connected in series with each other, wherein each of the driving thin-film transistor units comprises a wiring side and a capacitor side, and any two adjacent driving thin-film transistor units are spaced apart, the driving thin-film transistor units are shaped as rectangles, the wiring side is located on a short side of the rectangles, and the capacitor side is located on a long side of the rectangles, each of the driving thin-film transistor units comprises a source side and a drain side located on the wiring side;

a plurality of first capacitor areas, wherein each of the first capacitor areas is disposed between two adjacent capacitor sides of the driving thin-film transistor units; and a plurality of second capacitor areas, wherein each of the second capacitor areas is disposed on one of the source side or the drain side;

wherein the source side and the drain side are parallel to the wiring side and the plurality of second capacitor areas.

2. The GOA circuit layout as claimed in claim 1, comprising series wiring disposed on the wiring side of the driving thin-film transistor units, and any two of the adjacent driving thin-film transistor units are connected in series with each other through the series wiring.

3. The GOA circuit layout as claimed in claim 2, wherein each of the driving thin-film transistor units comprises two channels, a length direction of the channels is parallel with the capacitor side, and a distance between two adjacent first capacitor areas is greater than or equal to a width of the two channels.

4. The GOA circuit layout as claimed in claim 3, wherein the width of the two channels is adjustable.

5. The GOA circuit layout as claimed in claim 3, wherein each of the second capacitor areas is disposed on the source side and is connected to the first capacitor areas through the source side.

6. The GOA circuit layout as claimed in claim 2, wherein the driving thin-film transistor units connected in series with each other comprise driving thin-film transistor units located at two ends of a series structure and driving thin-film transistor units located at a middle of the series structure, the driving thin-film transistor units located at the two ends of the series structure comprise one channel, and a length direction of the channel is parallel with the capacitor side.

7. The GOA circuit layout as claimed in claim 6, wherein each of the second capacitor areas is disposed on the drain side and is connected to the first capacitor areas through the drain side.

8. A gate driver on array (GOA) circuit layout, comprising:

a driving thin-film transistor area divided into a plurality of driving thin-film transistor units connected in series with each other, wherein each of the driving thin-film transistor units comprises a wiring side and a capacitor side, and any two adjacent driving thin-film transistor units are spaced apart, the driving thin-film transistor units are shaped as rectangles, the wiring side is located on a short side of the rectangles, and the capacitor side is located on a long side of the rectangles, each of the driving thin-film transistor units comprises a source side and a drain side located on the wiring side;

a plurality of first capacitor areas, wherein each of the first capacitor areas is disposed between two adjacent capacitor sides of the driving thin-film transistor units;

a plurality of second capacitor areas, wherein each of the second capacitor areas is disposed on one of the source side or the drain side; and series wiring disposed on the wiring side of the driving thin-film transistor units, and any two of the adjacent driving thin-film transistor units are connected in series with each other through the series wiring;

wherein the source side and the drain side are parallel to the wiring side and the plurality of second capacitor areas.

9. The GOA circuit layout as claimed in claim 8, wherein each of the driving thin-film transistor units comprises two channels, a length direction of the channels is parallel with the capacitor side, and a distance between two adjacent first capacitor areas is greater than or equal to a width of the two channels.

10. The GOA circuit layout as claimed in claim 9, wherein the width of the two channels is adjustable.

11. The GOA circuit layout as claimed in claim 9, wherein each of the second capacitor areas is disposed on the source side and is connected to the first capacitor areas through the source side.

12. The GOA circuit layout as claimed in claim 8, wherein the driving thin-film transistor units connected in series with each other comprise driving thin-film transistor units located at two ends of a series structure and driving thin-film transistor units located at a middle of the series structure, the driving thin-film transistor units located at the two ends of the series structure comprise one channel, and a length direction of the channel is parallel with the capacitor side.

13. The GOA circuit layout as claimed in claim 12, wherein each of the second capacitor areas is disposed on the drain side and is connected to the first capacitor areas through the drain side.

* * * * *